US005459007A

United States Patent [19]

Larson et al.

[11] Patent Number: 5,459,007

[45] Date of Patent: Oct. 17, 1995

[54] LIQUID DEVELOPER COMPOSITIONS WITH BLOCK COPOLYMERS

[75] Inventors: James R. Larson, Fairport; John W. Spiewak, Webster; Joseph Mort, Webster; Inan Chen, Webster; Martin A. Abkowitz, Webster; Homer Antoniadis, Rochester, all of N.Y.

[73] Assignee: Xerox Corporation, Stamford

[21] Appl. No.: 249,916

[22] Filed: May 26, 1994

[51] Int. Cl.[6] ..... G03G 9/135

[52] U.S. Cl. ..... 430/115; 430/117

[58] Field of Search ..... 430/114, 115, 430/117

[56] References Cited

U.S. PATENT DOCUMENTS

| | | | |
|---|---|---|---|
| 4,207,429 | 11/1987 | Trout | 430/115 |
| 5,019,477 | 5/1991 | Feider | 430/115 |
| 5,030,535 | 7/1991 | Drappel et al. | 430/116 |
| 5,035,972 | 7/1991 | El-Sayed et al. | 430/115 |
| 5,130,221 | 7/1992 | El-Sayed et al. | 430/115 |
| 5,290,653 | 3/1994 | Pearlstine | 430/115 |
| 5,306,591 | 4/1994 | Larson et al. | 430/115 |
| 5,308,731 | 5/1994 | Larson et al. | 430/115 |

*Primary Examiner*—Christopher D. Rodee
*Attorney, Agent, or Firm*—E. O. Palazzo

[57] ABSTRACT

A liquid developer comprised of a liquid, thermoplastic resin particles, a nonpolar liquid soluble charge director comprised of an ionic or zwitterionic quaternary ammonium block copolymer ammonium block copolymer, and wherein the number average molecular weight thereof of said charge director is from about 70,000 to about 200,000.

32 Claims, 2 Drawing Sheets

LIQUID DEVELOPER COMPOSITIONS WITH BLOCK COPOLYMERS

BACKGROUND OF THE INVENTION

This invention is generally directed to liquid developer compositions and, in particular, to liquid developers containing high molecular weight ionic or zwitterionic ammonium block copolymers. More specifically, in embodiments the present invention relates to liquid developers with charge directors derived from the alkylation or protonation of poly-2-ethylhexylmethacrylate-co-N',N'dimethylamino-2-ethylmethacrylate (EHMA-DM AEMA) A-B diblock copolymers which form inverse micelies with the ammonium ionic or polar end of the block copolymer directed or faced inward and the nonpolar EHM A tail pointing in a direction outward toward the hydrophobic hydrocarbon vehicle selected for the liquid developer, and wherein the number average molecular weight, determined, for example, from by dividing the number of moles of monoinitiator into the number of grams of acrylic monomer being initiated by the charged molar quantity of monoinitiator, of the charge director is from about 70,000 to about 200,000, preferably from about 80,000 to about 150,000, and more preferably about 85,000 to 100,000.

With the aforementioned molecular weights, there are enabled liquid developers with a number of advantages such as high particle charge with low conductivities. The low conductivities result primarily from the larger micelies which originate from the high molecular weight charge director. The large micelie reduces the conductivity, it is believed, in, for example, the following manner: 1) the electrophoretic mobility is reduced as the size of the micelie increases due to viscous drag; and 2) as the size of the micelie increases, the number of micelies decreases at the same total mass loading of the charge director, resulting in a decrease in the micelie charge density. For example, the effect of charge director molecular weight on the electrophoretic mobility, size, and charge density of micelies formed from the AB diblock ammonium charge directors is illustrated in the following Table.

| Charge Director Molecular Weight ($M_n$) | Conductivity of 0.1% (by weight) Charge Director in NORPAR 15 (ps/cm) | Charged Micelle Electrophoretic Mobility (E-6 $cm^2/Vs$) | Micelle Charge Density of 0.1% (by weight) Charge Director ($\mu C/cm^3$) |
|---|---|---|---|
| Very Low (2K) | 43 | 11 | 3.5 |
| Low (4K) | 43 | 5.4 | 5.1 |
| Medium (25K) | 6 | 2.5 | 1.9 |
| Medium (50K) | 2 | 2.2 | 1.0 |
| High (93K) | 0.6 | 1.5 | 0.5 |

Furthermore, it has been determined that these high molecular weight charge directors result in low conductivity liquid toner dispersions with high particle charge. For example it has been found that a developer charged with a 93,519 molecular weight AB diblock EHMA-DMAEMA.HBr enables particles with a mobility greater than 4 E-10 $m^2/Vs$ measured, for example, by the ESA method disclosed herein, and a conductivity of a 1 percent developer solids liquid toner dispersion measured with a Scientifica AC conductivity meter disclosed herein of about less then 4 ps/centimeter. The corresponding liquid toner dispersion charged with a 4,000 molecular weight AB diblock EHMA-DMAEMA-HBr enables particles with a mobility of less than 3.5 E-10 $m^2/Vs$ and a conductivity greater than 8 ps/centimeters. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate, and can also lead to image defects such as smears and hollowed fine features. To overcome or minimize such problems, the liquid toners of the present invention were arrived at after substantial research efforts, and which toners result in, for example, sufficient particle charge for transfer and maintain the mobility within the desired range of the particular imaging system employed. Advantages associated with the present invention include a high developer particle charge, a low conductivity; and further increasing the desired negative charge on the developer particles, and in embodiments providing a charge director that is superior to similar charge directors like tetraalkyl quaternary ammonium block copolymers, lecithin, and metal salts of petroleum fractions. The superior charge can result in improved image development and superior image transfer. The low conductivity of the dispersions obtained in the present invention improve the developability of the liquid toner dispersion as the high concentration of mobile ions in high conductivity liquid dispersions compete with the toner particles for the latent electrostatic image in the xerographic process. The high concentration reduction of mobile ions can also disrupt other steps in the xerographic printing process such as the electrostatic transfer of the image from the image bearing member to a substrate. In some desirable applications of the xerographic printing process, a subsequent electrostatic image is applied to the image bearing member over a previously developed image. In this process, often referred to as an image-on-image process, a high concentration of mobile ions in the first image would distort the electrostatic latent image being developed in the subsequent development.

A latent electrostatic image can be developed with toner particles comprised of resin, pigment, and charge adjuvant dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin, colorant like pigment or dye, and a dispersant nonpolar liquid. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as determined by the Horiba Capa 500 or 700 particle sizers.

Since the formation of images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles, may be selected from known thermoplastics, including fluoropolymers.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer, and the compatible segment thereof is oriented to be compatible with other resins and a coloring agent contained in the toner whereby the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009 and 5,034,299.

The disclosures of each of the U.S. patents mentioned herein are totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In copending patent application U.S. Ser. No. 249,827, filed concurrently herewith, the disclosure of which is totally incorporated herein by reference, there is illustrated a liquid developer with AB copolymer charge directors.

In U.S. Pat. No. 5,306,591, there is disclosed a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

In copending patent application U.S. Ser. No. 185,341, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

Further, illustrated in copending patent applications U.S. Ser. No. 200,988 is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment; in U.S. Ser. No. 204,012 is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment; and in U.S. Ser. No. 204,016 is a liquid developer comprised of thermoplastic resin particles, optional pigment, and a charge director comprised of a mixture of an organic anioinic complex phosphate ester and organic aluminum complex, or mixtures thereof of the formulas

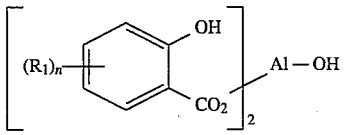

or

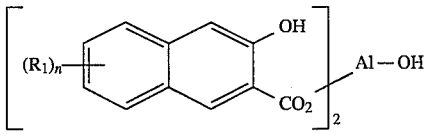

wherein $R_1$ is selected from the group consisting of hydrogen and alkyl, and n represents a number, the disclosures of which are totally incorporated herein by reference.

DESCRIPTION OF THE FIGURES

There is illustrated in FIG. 1 data from Example IV and Control 9, conductivity versus CD (charge director) concentration after two weeks of aging of cyan developers charged with AB diblock protonated (salt) ammonium bromide copolymer CDs (charge director). Line 1 of FIG. 1 represents the conductivity (ps/cm) of developers containing low molecular weight charge director controls 9A to 9E, and line 2 represents the conductivity (ps/cm) of developers containing high molecular weight charge directors, reference Examples IVA to IVE.

SUMMARY OF THE INVENTION

Figure 1:
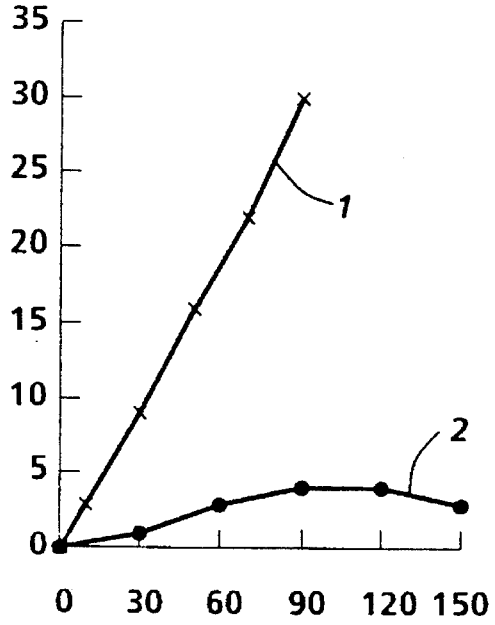

It is an object of the present invention to provide liquid developers with many of the advantages illustrated herein.

Another object of the present invention is to provide liquid developers capable of high particle charging and fast toner charging rates.

Further another object of the present invention is to provide a liquid developer with high particle charges and low conductivities.

Another object of the invention is to provide a negatively charged liquid developer wherein there are selected as charge directors ionic and/or zwitterionic ammonium AB diblock copolymers and which copolymer has an important weight average molecular weight of from about 70,000 to about 200,000. Examples of acceptable conductivity and mobility ranges for developers charged with the high molecular weight charge directors of this invention are illustrated herein. Conductivities measured at ambient temperature (21° to 23° C.) for developers containing one percent toner solids are considered high in the 10 to 20 pmhos/centimeter range and very high at greater than 20 pmhos/centimeter. Optimum conductivities are less than about 5 pmhos/centimeter and preferably less than about 3 ps/centimeter. As conductivities increase above the optimum range, excess ions can compete with toner particles of the same charge for development of the latent image giving rise to low developed mass resulting in low print density images. In addition to having an optimum conductivity of less than 10 pmho/centimeter, the liquid toner or developer of this invention also possesses a mobility of at least $-2\times10^{-10}$ $m^2/Vs$ and preferably greater than $-3\times10^{-10}$ $m^2/Vs$ in embodiments.

It is still a further object of the invention to provide a liquid developer wherein developed image defects, such as smearing, loss of resolution and loss of density, are eliminated or minimized.

It is another object of the invention to provide low conductivity liquid developers which will be effective in an image-on-image xerographic printing process where an image is developed on a latent image bearing member in the xerographic process, and then that image bearing member is passed through the xerographic charging, imagewise discharging, and development steps to develop a multilayered image. The subseqent development steps can be with liquid toner dispersions of colors different than the first or previous development resulting in a multicolored image which can be transferred from the now multiimage bearing member to a substrate.

Also, in another object of the present invention there are provided negatively charged liquid developers with certain high molecular weight ionic and/or zwitterionic ammonium AB diblock copolymer charge directors, which are superior in embodiments to, for example, low molecular weight ammonium block copolymers since, for example, they result in higher negative toner particle charge and lower conductivity. For example, it has been found that a developer charged with a 93,519 molecular weight AB diblock EHMA-DMAEMA.HBr obtains particles with a mobility greater than 4 E-10 $m^2/Vs$ (measured by the ESA technique disclosed herein) and a conductivity (of a 1 percent developer solids liquid toner dispersion measured with a Scientifica AC conductivity meter disclosed herein) of about less then 4 ps/centimeter. The corresponding liquid toner dispersion charged with 3,945 molecular weight AB diblock EHMA-DMAEMA.HBr obtains particles with a mobility less than 3.5 E-10 $m^2/Vs$ and a conductivity greater than 8 ps/centimeter.

Also, in another object of the present invention there are provided negatively charged liquid developers with certain high molecular weight ionic and/or zwitterionic ammonium AB diblock copolymer charge directors, which are superior in embodiments to, for example, low molecular weight ionic and/or zwitterionic ammonium AB diblock copolymers since, for example, they result in higher negative particle charge and lower conductivity.

Another object of the present invention resides in the provision of negatively charged liquid toners with high molecular weight ionic and/or zwitterionic ammonium block copolymers, and wherein in embodiments enhancement of the negative charge of NUCREL® based toners, especially cyan and magenta toners, is enhanced.

These and other objects of the present invention can be accomplished in embodiments by the provision of liquid developers with certain charge directors. In embodiments, the present invention is directed to liquid developers comprised of a toner resin, pigment, charge additive and a charge director comprised of a high molecular weight ionic and/or zwitterionic ammonium block copolymer. In embodiments, the aforementioned charge director contains a polar quaternary ammonium A block and a second B block, constituent or component that is nonpolar thereby enabling hydrocarbon solubility, and which AB diblock copolymers can be obtained from group transfer polymerization, and a subsequent polymer modification reaction of the group transfer prepared AB diblock copolymer in which the ionic or zwitterionic site is introduced into the polar A block, and wherein the number average molecular weight of the charge director is from about 70,000 to about 200,000, and preferably from 80,000 to 150,000, and more preferably from 85,000 to 100,000. In embodiments, the present invention relates to the provision of liquid developers with certain charge directors. Also, in embodiments, the present invention is directed to liquid developers comprised of a toner resin, pigment, and a charge director comprised of a high molecular weight ionic and/or zwitterionic ammonium AB diblock copolymer. In embodiments, the aforementioned charge director contains an ionic or zwitterionic ammonium group and a constituent or component that is non polar thereby enabling hydrocarbon solubility, and which block copolymers can be obtained by group transfer polymerization.

Embodiments of the present invention relate to a developer comprised of a liquid, thermoplastic resin particles, and a nonpolar liquid soluble ammonium block copolymer charge director; and a liquid electrostatographic developer comprised of (A) a nonpolar liquid having a Kauri-butanol value of from about 5 to about 30, and present in a major amount of from about 50 percent to about 95 weight percent; (B) thermoplastic resin particles having an average volume particle diameter of from about 5 to about 30 microns and pigment; (C) a nonpolar liquid soluble high molecular weight ionic or zwitterionic ammonium block copolymer; and (D) optionally, but preferably a charge adjuvant.

Suitable charge directors of the present invention can be represented by the formula

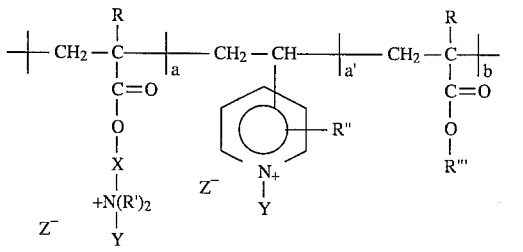

wherein R is hydrogen, alkyl, aryl, or alkylaryl; R" is alkyl, aryl, cycloalkyl, cycloalkylalkyl, cycloalkylaryl or alkylaryl with or without heteroatoms; R"' is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms; Y is hydrogen, alkyl of 1 to about 25 carbon atoms, alkylaryl and aryl from 6 to about 30 carbon atoms with or without heteroatoms; Z- is an anion such as bromide, hydroxide, chloride, nitrate, p-toluenesulfonate, sulfate, phosphate, fluoride, dodecylsulfonate, dodecylbenzenesulfonate, acetate, trifluroracetate, chloroacetate, stearate, and the like; $aM_a+a'M_{a'}$ is about 3,500 to 120,000 and bMb is 28,000 to 190,000 wherein a, a' and b are the number average degree of polymerization (DP) and $M_a$, $M_{a'}$ and $M_b$ are the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms.

Examples of specific diblock copolymer charge directors with an $M_n$ of from about 70,000 to about 200,000 include poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2-trimethylammoniumethyl acrylate p-toluenesulfonate co-2-ethylhexyl methacrylate], poly[2-trimethylammoniumethyl acrylate nitrate co-2-ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly[2-trimethylammoniumethyl methacrylate hydroxide co-2-ethylhexyl acrylate], poly[2-trimethylammoniumethyl acrylate hydroxideco-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2-trimethylammoniumethyl methacrylate bromide co-N,N-dibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate, poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyi acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

Other examples of suitable diblock copolymer charge directors include poly[4-vinyI-N,N-dimethylanilinium bromide co-2-ethylhexyl methacrylate], poly[4-vinyI-N,N-dimethylanilinium tosylate co-2-ethylhexyl methacrylate], poly [ethylenimmonium bromide co-2-ethylhexyl methacrylate], and poly[propylenimmonium bromide co-2-ethylhexyl methacrylate].

Further examples of diblock copolymer charge directors include poly[4-vinyI-N,N-trimethylanilinium bromide co-2-ethylhexyl methacrylate], poly[4-vinyI-N,N-triethylanilinium chloride co-2-ethylhexyl methacrylate], poly[quaternary ethylenimmonium fluoride co-2-ethylhexyl methacrylate], poly[quaternary propylenimmonium hydroxide co-2-ethylhexyl methacrylate], and polyvinyl-N-ethylpyridinium nitrate-co-pdodecylstyrene.

Preferred ammonium AB diblock copolymer charge directors of this invention contain a polar A block with a positively charged ammonium nitrogen and a nonpolar B block which has sufficient aliphatic content to enable the block copolymer to more effectively dissolve in a nonpolar liquid having a Kauri-butanoi value of less than about 30. The A block has, for example, a number average molecular weight range of from about 3,500 to about 120,000 and the B block has a number average molecular weight range of from about 28,000 to about 190,000. Number average degree of polymerization (DP) refers to the average number of monomeric units per polymer chain. It is related to the number average molecular weight (Mn) by the formula $M_n=M_0\times DP$, where $M_0$ is the molecular weight of the monomer. Amine nitrogen alkylation to form the ammonium salt in the polar A block for satisfactory acceptable charge director performance is in embodiment at least 80 mole percent and preferably at least 90 mole percent.

In another embodiment, the AB ammonium diblock charge director is comprised of A and B blocks, wherein the A block is an alkyl, aryl or alkylaryl amine containing polymer wherein the alkyl, aryl, or alkylaryl moiety which can be substituted or unsubstituted. Useful A blocks are polymers prepared from at least one monomer selected from the group consisting of 1) $CH_2=CRCO_2R^1$ wherein R is hydrogen, alkyl, aryl, or alkylaryl of 1 to 20 carbons and R1 is alkyl of 1 to 20 carbons where the terminal end of $R^1$ is of the general formula —$N(R^2)_3X$— where N is nitrogen, $R^2$ is alkyl, cycloalkyl, aryl, or alkylaryl of 1 to 20 carbons, X— is an anion such as OH—, Cl—, Br—, p-toluene sulfonate, dodecylsulfonate, nitrate, phosphate, and the like; and 2) 2, 3, or 4-vinylpyridinium salt wherein the ring carbon atoms not substituted with the vinyl group are substituted with $R^2$ and the ring nitrogen is substituted with R as defined above. Examples of monomers useful as A blocks include 2-(N,N,N-trimethylammonium hydroxide)ethyl methacrylate, 2-(N,N,N-triethylammonium bromide)ethyl methacrylate, 2-(N,N,N-trimethylammonium chloride)ethyl acrylate, 2-(N,N,N-trimethylammonium p-toluene-sulfonate)ethyl methacrylate, 4-vinyl-N-methyl-pyridinium p-toluene sulfonate, 2-vinyl-N-ethylpyridinium acetate-3-vinyl-N-methyl-pyridinium bromide, and the like. Useful B blocks are polymers prepared from at least one monomer selected from the group consisting of butadiene, isoprene, and compounds of the general formulas, $CH_2=CHR^3$, $CH_2=CHCO_2R^3$, $CH_2=CRCO_2R^3$, where $R^3$ is alkyl of about 6 to about 30 carbons, or alkylaryl of 8 to 30 carbons. Examples of monomers useful in preparing B blocks include 2-ethylhexylmethacrylate, laurylmethacrylate, stearylmethacrylate, butadiene, isoprene, 1-dodecene, 2-ethylhexylacrylate, p-tertiary butylstyrene, and the like. Aryl includes groups with 6 to about30 carbon atoms, such as phenyl, benzyl, naphthyl and the like, and alkyi includes methyl, ethyl, propyl, butyl, pentyl, and the like.

Other suitable nonpolar liquid soluble charge director compound examples selected for the developers of the present invention in various effective amounts, such as from about 0.5 to about 100 weight percent of developer solids, which is also represented as 5 milligrams to 1,000 milligrams of charge director solids to 1 gram of developer solids, and preferably 1 percent to 20 percent by weight relative to developer solids, which is also referred to as 10 milligrams to 200 milligrams of charge director solids to 1 gram of developer solids, include zwitterionic AB diblock copolymers represented by the following formula

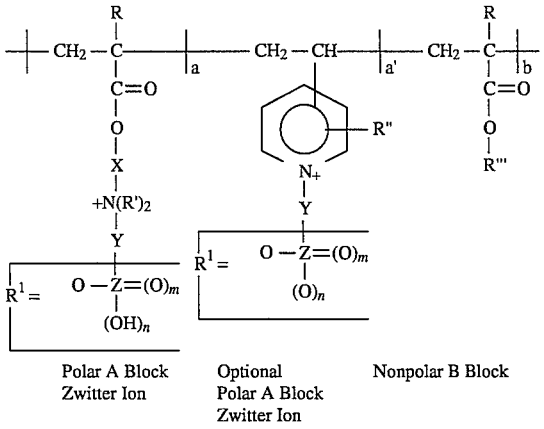

wherein R is hydrogen, alkyl, aryl, or alkylaryl; R1 is a conjugate oxygen containing acid anion derived from carbon, sulfur, or phosphorous; Z is carbon (C), sulfur (S), phosphorous (P), or substituted phosphorous (P-R with R defined as above); m is 1 or 2 doubly bonded oxygen atoms; n is 0 or 1 hydroxyl groups; R' is alkyl, aryl, cycloalkyl, cycloalkylenyl cycloalkylalkyl, cycloalkylaryl or alkylaryl with or Without heteroatoms; R" is alkyl, aryl, cycloalkyl, cycloalkylalkyl, cycloalkylaryl or alkylaryl with or without heteroatoms; R"' is alkyl, aryl, cycloalkyl, cycloalkylalkyl, cycloalkylaryl or alkylaryl of 4 to 20 carbons with or without heteroatoms; X is alkylene or arylalkylene of, for example, about 2 to 10 carbons with or without heteroatoms; Y is alkylene or arylalkylene of 1 to 10 carbons with or without heteroatoms; $aM_a+a'M_{a'}$ is about 3,500 to 120,000 and $bM_b$ is 28,000 to 190,000 wherein a, a' and b are the number average degree of polymerization (DP) and $M_a$, $M_{a'}$ and $M_b$ are the corresponding repeat unit molecular weights. Alkyl includes groups with 1 to about 25 carbon atoms; aryl includes groups with from 6 to about 24 carbon atoms; and alkylene can include groups with from 1 to about 25 carbon atoms.

Examples of specific zwitterionic diblock copolymer charge directors include poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2-ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonateN-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacryl ate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate). In all of the above examples, the corresponding acrylate copolymer, instead of the methacrylate copolymer, could also be employed as suitable nonpolar liquid soluble zwitterionic AB diblock copolymer charge directors. Additional suitable examples of nonpolar liquid soluble zwitterionic AB diblock copolymer charge directors include poly(4-vinylpyridinium-N-methylenecarboxylate-co-2-ethylhexyl methacrylate), poly(4-vinylpyridinium-N-propylenesulfonate-co-2-ethylhexyl methacrylate), poly(4-vinylpyridinium-N-propylenephosphonate-co-2-ethylhexyl methacrylate), poly(4-vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co-2-ethylhexyl methacrylate), poly(4-vinylpyridinium-N-ethyleneoxyethylenesulfonate-co-2-ethylhexyl methacrylate), poly(4-vinylpyridinium-N-ethyleneoxyethylenephosphonate-co-2-ethylhexyl methacrylate), poly[4-vinylpyridinium-N-μmethylenecarboxylate-co-p-tert butylstyrene), and the like. In the aforementioned pyridinium examples, additional examples of nonpolar liquid soluble zwitterionic AB diblock copolymer charge directors include poly(2-vinylpyridinium-N-methylenecarboxylate-co-2-ethylhexyl methacrylate), poly(2-vinylpyridinium-N-propylenesulfonate-co-2-ethylhexyl methacrylate), poly(2-vinylpyridinium-N-propylenephosphonate-co-2-ethylhexyl methacrylate), poly(2-vinylpyridinium-N-propylenephosphinate-co-2-ethylhexyl methacrylate), poly(2-vinylpyridinium-N-propylenesulfinate-co-2-ethylhexyl methacrylate), poly(2-vinylpyridinium-N-ethyleneoxyethylenecarboxylate-co-2-ethylhexyl methacrylate), poly(2-vinylpyridinium-N-ethyleneoxyethylenesulfonate-co-2-ethylhexyl methacrylate), poly(2-vinylpyridinium-N-ethyleneoxyethylenephosphonate-co-2-ethylhexyl methacrylate), poly[3-vinylpyridinium-N-methylenecarboxylate-co-p-tertiary butylstyrene), poly(3-vinylpyridinium-N-methylenecarboxylate-co-2-ethylhexyl methacrylate), poly(3-vinylpyridinium-N-propylenesulfonate-co-2-ethylhexyl methacrylate), poly(3-vinylpyridinium-N-propylenephosphonate-co-2-ethylhexyl methacrylate), poly(3-vinylpyridinium-N-propylenephosphinate-co-2-ethylhexyl methacrylate), poly(3-vinylpyridinium-N-propylenesulfinate-co-2-ethylhexyl methacrylate), poly(3-vinylpyridinium-N-ethyleneoxyethylenecarboxylate-co-2-ethylhexyl methacrylate), poly(3-vinylpyridinium-N-ethyleneoxyethylenesulfonate-co-2-ethylhexyl methacrylate), poly(3-vinylpyridinium-N-ethyleneoxyethylenephosphonate-co-2-ethylhexyl methacrylate), poly[3-vinylpyridinium-N-methylenecarboxylate-co-p-tert butylstyrene), and the like.

The preferred repeat unit content of the polar A block is 60 to 5 mole percent and is more preferably at 40 to 10 mole percent, and the preferred repeat unit content of the nonpolar B block is 40 to 95 mole percent and is more preferably at 60 to 90 mole percent. Amine nitrogen alkylation to form the zwitterionic ammonium polar A block repeat unit wherein both cationic and anionic sites are covalently bonded within the same polar repeat unit should be at least 80 mole percent and preferably at least 90 mole percent for satisfactory charge director performance. The polar A block may be comprised entirely of either of the polar blocks illustrated herein or it may be complex wherein the optional polar A block repeat unit may be 0.1 to 99.9 mole percent of all the polar A block repeat units present. The complex polar A block may be segmented, tapered or random when it contains more than one repeat unit.

In another embodiment, the AB zwitterionic ammonium diblock charge director is comprised of A and B blocks as described hereinafter. The polar A block is an alkyl, aryl or alkylaryl amine containing polymer wherein the alkyl, aryl, or alkylaryl moiety can be substituted or unsubstituted and be cyclic or noncyclic. Useful A blocks are polymers prepared from at least one monomer selected from the group consisting of 1) $CH_2{=}CRCO_2R^1$ wherein R is hydrogen, alkyl, aryl, or alkylaryl, and $R^1$ is a conjugate acid monoanion wherein m=0 to 2 and n=0 to 2, and Z is carbon, sulfur, or phosphorus. Specific examples of $R^1$ groups include carboxylate, sulfonate, sulfinate, phosphonate, phosphinate, phosphate and sulfate. X and Y are alkylene or arylalkylene with or without heteroatoms wherein X contains 2 to 10 carbon atoms and Y contains 1 to 10 carbon atoms. Examples of X groups include 1,2-ethylene, 1,3-propylene, 1,2-propylene, 1,4-butylene, 1,6-hexylene, 1,10-decamethylene, 3,3,5,5-tetramethylhexylene, 1,4-cis or trans dimethylenecyclohexylene, 1,4-phenylenedimethylene, and 1-ethyleneoxy-5-ethylene. Examples of Y groups include methylene, 1-ethylene-2-oxy and all of the above cited X groups. R' is alkyl, aryl, cycloaikyl, cycloalkylenyl, cycloalkylalkyl, cycloalkylaryl or alkylaryl of 1 to 20 carbons with or without heteroatoms. Suitable R' groups include methyl, ethyl, allyl, hexyl, lauryl, cetyl, stearyl, 2-ethoxyethyl, benzyl, phenethyl, 1-methylenenaphthyl, cyclohexyl, cyclohexylmethylene, cyclopentylene, cyclohexylene, 4-ethylcyclohexyl, 4-cyclohexylbenzyl, 4-ethylbenzyl, 4-methoxybenzyl, and 4-nitrobenzyl. R" is alkyl, aryl, cycloalkyl, cycloalkylalkyl, cycloalkylaryl or alkylaryl with or without heteroatoms. Suitable R" groups include methyl, ethyl, allyl, butyl, isoamyl, methoxyl, phenyl, benzyl and cyclohexyl.

Examples of polar A block monomers, selected in the preferred monomer range of 60 to 5 mole percent, which after copolymerization to unquaternized A block precursors that are subsequently quaternized to zwitterionic quaternary ammonium polar A block copolymers, include N,N-dimethylamino-N-2-ethylmethacrylate, N,N-diethylamino-N-2-ethylmethacrylate, N,N-dimethylamino-N-2-ethylacrylate, N,N-diethylamino-N-2-ethylacrylate, N-morpholino-2-ethyl methacrylate, 4-vinylpyridine, 3-vinylpyridine, and 2-vinylpyridine. Examples of monomers which after copolymerization give useful A blocks directly include N,N,dimethyl-N-methylenecarboxylate-N-ammoniumethyl methacrylate, N,N-diethyl-N-methylenecarboxylate-N-ammoniumethyl methacrylate, N,N-dimethyl-N-propylenesulfonate-N-ammoniumethyl methacrylate, N,N,dimethyl-N-methylenecarboxylate-N-ammoniumethyl acrylate, N,N-dimethyl-N-propylenesulfonate-N-ammoniumethyl acrylate, N,N-dimethyl-N-butylenephosphonate-N-ammoniumethyl methacrylate, N,N-dimethyl-N-butylenephosphinate-N-ammoniumethyl methacrylate, N,N-morpholino-N-methylenecarboxylate-N-ammoniumethyl methacrylate, N,N-morpholino-N-propylenesulfonate-N-ammoniumethyl methacrylate, 4-vinyl-N-methylene pyridinium carboxylate, 4-vinyl-N-propylenepyridinium sulfonate, 4-vinyl-N-butylenepyridinium phosphonate, 2-vinyl-N-methylene pyridinium carboxylate, 3-vinyl-N-methylene pyridinium carboxylate, and the like.

Examples of nonpolar B block monomers, selected in the preferred range of40 to 95 mole percent, provide polymers prepared from at least one B block monomer selected from the group consisting of butadiene, isoprene, chloroprene, mycrene, and compounds of the general formulas $CH_2=CHR'''$, $CH_2=CHCO_2R''$, $CH_2=CRCO_2R'''$, where R''' is alkyl, aryl, cycloalkyl, cycloalkylalkyl, cycloalkylaryl or alkylaryl with or without heteroatoms of 4 to 20 carbons. Examples of monomers useful in preparing the B blocks include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, mycrene, 1-dodecene, p-tert butylstyrene, and the like. Optional useful nonpolar B blocks are polymers prepared from at least one monomer selected from the group consisting of $CH_2=CHCON(R')_2$ and $CH_2=CRCON(R')_2$ where R and R' are as indicated herein.

The charge director can be selected for the liquid developers in various effective amounts, such as for example from about 0.5 percent to 100 percent by weight relative to developer solids and preferably 1 percent to 20 percent by weight relative to developer solids. Developer solids includes toner resin, pigment, and optional charge adjuvant. Without pigment, the developer may be selected for the generation of a resist, or a printing plate and the like.

Embodiments of the present invention relate to a liquid electrostatographic developer comprised of (A) a nonpolar liquid having a Kauri-butanol value of from about 5 to about 30, and present in a major amount of from about 50 percent to about 95 weight percent; (B) thermoplastic resin particles with, for example, an average volume particle diameter of from about 0.5 to about30 microns and preferably 1.0 to about 10 microns in average volume diameter and pigment; (C) a nonpolar liquid soluble ionic or zwitterionic ammonium AB diblock copolymer charge director wherein both cationic and anionic sites are covalently bonded within the same polar repeat unit in the polar A block of the block copolymer, and wherein the weight average molecular weight of the charge director is from about 70,000 to about 200,000 ; and (D) optionally a charge adjuvant compound.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as 1013 ohm/centimeters or more. Preferably, the liquid selected in embodiments is a branched chain aliphatic hydrocarbon. A nonpolar liquid of the ISOPAR® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohmcentimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected. Other useful liquid include mineral oils such as the SUPURLA® series available from the Amoco Oil Company.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid; and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps like aluminum or magnesium stearate or octoate, fine particle size oxides, such as oxides of silica, alumina, titania, and the like, paratoluene sulfonic acid, and polyphosphoric acid may be added. Negative charge adjuvants can increase the negative charge of the toner particle, while the positive charge adjuvants can increase the positive charge of the toner particles. With the invention of the present application, the adjuvants or charge additives can be comprised of the metal catechol and aluminum hydroxyacid complexes illustrated in U.S. Pat. No. 5,306,591 and U.S. Pat. No. 5,308,731, the disclosures of which are totally incorporated herein by reference, and which additives in combination with the charge directors of the present invention have the following advantages over the aforementioned prior art charge additives: improved toner charging characteristics, namely an increase in particle charge, as measured by ESA mobility, from −1.4 E-10 $m^2/Vs$ to −2.3 E-10 $m^2/Vs$, that results in improved image development and transfer, from 80 percent to 93 percent, to allow improved solid area coverage from transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer. Also, as charge adjuvants there can be selected the components as illustrated in copending patent application U.S. Pat. No. 5,366,840, Alohas as a CCA, the disclosure of which is totally incorporated herein by reference.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example, greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example, about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media is particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 millivolts for a 10 percent (v/v) suspension of LUDOX® (E.I. DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer manufactured by Horiba Instruments, Inc., Irvine, Calif.

EXAMPLE 1

CYAN LIQUID TONER PREPARATION

One hundred and seventy-nine and five tenths (179.5) grams of NUCREL 599® a copolymer of ethylene and methacrylic acid with a melt index at 190° C. of 500 dg/minute, available from E.I. DuPont de Nemours & Company, Wilmington, Del., 45.4 grams of the cyan pigment PV FAST BLUE™, 2.30 grams of the charge adjuvant hydroxy bis[3,5-tertiary butyl salicylic] aluminate monohydrate prepared by the ambient temperature synthesis described in Example V, and 307.4 grams of NORPAR 15® carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° to 96° C. for 2 hours and cooled by running water through the attritor jacket to 26° C. An additional 980.1 grams of NORPAR 15® were added, and ground in the attritor for an additional 4.5 hours. An additional 1,550.7 grams NORPAR 15® were added and the mixture was separated by the use of a metal grate from the steel balls yielding a liquid toner concentrate of 7.21 percent solids wherein solids include resin, charge adjuvant, and pigment and 92.59 percent NORPAR 15®. The particle diameter was 1.58 microns average by area as measured with a Horiba Cappa 700.

CONTROL 1

Low Molecular Weight Base Polymer (Charged $M_n$ of 3,945)

There was selected a sequential Group Transfer Polymerization (GTP) of 2-ethylhexyl methacrylate (EHMA) and 2-dimethylaminoethyl methacrylate (DMAEMA) to prepare the low molecular weight AB diblock base polymer, poly [2-ethylhexyl methacrylate (B block)-co-N,N-dimethylamino-N-ethyl methacrylate (A block)]. This low molecular weight AB diblock base polymer was then used to prepare the low molecular weight protonated ammonium bromide AB diblock copolymer charge director, poly[2-ethylhexyl methacrylate (B block)-co-N,N-dimethyl-N-ethyl methacrylate ammonium bromide (A block)], described in Control 8.

To a 5 liter round bottom flask equipped with a magnetic stirring football, an Argon inlet and outlet and a neutral alumina column was charged, through the alumina column later to be replaced by a rubber septum, which alumina column along with the reactor was maintained under a positive Argon flow and sealed from the atmosphere, 1,245 grams (6.28 mole) of freshly distilled 2-dimethylaminoethyl methacrylate monomer and 1,500 milliliters of freshly distilled (from sodium benzophenone) tetrahydrofuran (THF) solvent. Then, 78.0 milliliters (0.384 mole) of initiator, methyl trimethylsilyl dimethylketene acetal, were syringed into the reactor. The acetal was originally vacuum distilled and a middle fraction was collected and stored (under Argon) for polymerization initiation purposes. Then, 0.033 milliliter of a 0.3 molar solution of tetrabutylammonium acetate (catalyst) in the same dry tetrahydrofuran was syringed into the polymerization vessel. About 1 hour after the mild exotherm peaked, there were added 270 grams (1.72 mole) of freshly distilled 2-dimethylaminoethyl methacrylate monomer through the alumina column, and the solution was magnetically stirred for 18 hours at ambient temperature. Then, the tetrahydrofuran solvent was stripped with a rotoevaporator (4 hours at 40 to 60 millimeters Hg at 50° C. to 60° C.) and sufficient toluene solvent was added to the solid residue to complete the solvent exchange and to give a 50.86 weight percent toluene solution of the low molecular weight base polymer. The residual solid was generally stirred with toluene for about 16 to 18 hours at ambient temperature to obtain solution. This toluene solution was used to prepare the low molecular weight protonated ammonium bromide charge director described in Control 8.

The above charges of initiator and monomers provide an $M_n$ and average degree of polymerization (DP) for each block. For the EHMA nonpolar B block, the charged $M_n$ is 3,242 and the DP is 16.35, and for the DMAEMA polar A block, the charged $M_n$ is 703 and the DP is 4.47. The charged total AB diblock $M_n$ is, therefore, 3,945. $^1$H—NMR analysis was obtained on a fraction of a 1 to 2 gram sample of this low molecular weight base polymer solid isolated by rotoevaporating the toluene solvent at the same rotoevaporation conditions described above. $^1$H-NMR analysis of a 17.6 percent (g/dl) $CDCl_3$ solution of the copolymer indicated 77.8 mole percent (81.55 weight percent) EHMA and 22.2 mole percent (18.45 weight percent) DMAEMA. Nonaqueous titration of the tertiary aliphatic amine group in each DMAEMA repeat unit of the polar A block of this low molecular weight base polymer indicated a composition very similar to that ofthe $^1$H-NMR analysis 78.26 mole percent (81.95 weight percent) EHMA by difference and 21.74 mole percent (18.05 weight percent) DMAEMA by direct titration. The average DMAEMA content (18.25 weight percent) from both analyses in this low molecular weight base polymer was used in Control 8 to calculate the required amount of 48 percent hydrobromic acid required to make the charge director.

Group Transfer Polymerization (GTP) is similar to anionic polymerization in that (1) it is a living polymerization, and (2) the charged $M_n$ (number average molecular weight) of the resulting polymer is calculated in the same manner.

The charged $M_n$ is obtained by dividing the number of moles of monoinitiator, methyl trimethylsilyl dimethylketene acetal, into the number of grams of non-active hydrogen containing acrylic monomer (A) being initiated by the charged molar quantity of monoinitiator. After the polymerization is completed (that is about 1 hour after the mild exotherm begins to subside), the polymer reaches its charged $M_n$ assuming that there were no initiator quenching impurities present.

Initiator quenching impurities are active hydrogen containing molecules, most frequently oxygen nucleophiles such as alcohols and water, including atmospheric moisture. Active hydrogen materials in GTP means any material which contains a nucleophilic center capable of forming a covalent bond at tetravalent silicon. These impurities are removed by distillation of monomers and solvents from suitable drying agents and by baking out glassware to remove water from the glass.

Invariably, the obtained $M_n$ is larger than the charged $M_n$ since all the impurities are not removed or some are introduced in the handling of the materials. It was found that $M_n$ is usually always larger than charged $M_n$ because the denominator in the above ratio becomes smaller as monoinitiator is destroyed (destroyed means converted to some other molecular species that is no longer able to initiate a polymer chain).

Since GTP is a living polymerization, the polymer chains that result after all the A monomer has been converted to A polymer block, that is linked into A polymer chains, now await the same monomer A or a new B monomer (to make an AB diblock copolymer) to be added. These living polymer ends now become the new monoinitiator sites for growing the second monomer B. One must continue to dilligently exclude active hydrogen impurities to avoid killing off the live polymer end monoinitiator sites. If one does kill off some of these living polymer ends, one is faced with exactly the same problem described above, that is the denominator in the above ratio becomes smaller and one obtains a larger found $M_n$ for the B block than what was charged. For the B block, the charged $M_n$ is calculated by dividing the number of moles of polymer chains which is the same as the number of moles of originally added monoinitiator, methyl trimethylsilyl dimethylketene acetal (because we continue to assume an impurity less system which means that the two numbers will be the same) into the number of grams of B monomer being initiated by these living A block polymer end initiator sites. The same would be accomplished for a third monomer addition, which would be the addition of the first A monomer again, to provide an ABA triblock copolymer. The more monomer additions made, the more impurities are introduced resulting in a greater increase in found $M_n$ versus theoretical or charged $M_n$.

EXAMPLE II

High Molecular Weight Base Polymer Charged $M_n$ of 93519)

There was selected a sequential Group Transfer Polymerization (GTP) of 2-ethylhexyl methacrylate (EHMA) and 2-dimethylaminoethyl methacrylate (DMAEMA) to prepare the high molecular weight AB diblock base polymer, poly [2-ethylhexyl methacrylate (B block)-co-N,N-dimethylamino-N-ethyl methacrylate (A block)]. This high molecular weight AB diblock base polymer was then used to prepare the high molecular weight protonareal ammonium bromide AB diblock copolymer charge director, poly[2-ethylhexyl methacrylate (B block)-co-N,N-dimethyl-N-ethyl methacrylate ammonium bromide (A block)], described in Example III.

To a 100 milliliter round bottom flask equipped with a magnetic stirring football, an Argon inlet and outlet, and a neutral alumina column was charged through the alumina column, later to be replaced by a rubber septum; which alumina column along with the reactor was maintained under a positive Argon flow and sealed from the atmosphere, 20 milliliters of freshly distilled (from sodium benzophenone) tetrahydrofuran (THF) solvent, 9.00 grams (0.0572 mole) of freshly distilled 2-dimethylaminoethyl methacrylate monomer and an additional 8 milliliters of the same THF to rinse down the column. Then 0.2 milliliter of a 0.033 molar solution of tetrabutylammonium acetate (catalyst) in the same dry tetrahydrofuran was syringed into the polymerization vessel. Thereafter, 0.11 milliliter (0.00054 mole) of initiator, methyl trimethylsilyl dimethylketene acetal, was syringed into the reactor. The acetal was originally vacuum distilled and a middle fraction was collected and stored (under Argon) for polymerization initiation purposes. About one hour after the addition of the ketene acetal initiator, the mild exotherm began to subside. After an additional hour, the contents of the 100 milliliters reactor were transferred with a dry syringe into a second reactor (500 milliliter round bottom flask similarly equipped as the first reactor) which second reactor contained 41.5 grams (0.2093 mole) of freshly distilled 2-ethylhexyl methacrylate monomer and 50 milliliters of freshly distilled tetrahydrofuran solvent also at ambient temperature. The combined reactor contents were allowed to stir for 18 hours at ambient temperature. Thereafter, the tetrahydrofuran solvent was stripped with a rotoevaporator (1 hour at 40 to 60 millimeters Hg at 50 to 60° C.) and sufficient toluene solvent was added to the solid residue to complete the solvent exchange and to give a 48.14 weight percent toluene solution of the high molecular weight base polymer. The residual solid was generally stirred with toluene for about 16 to 18 hours at ambient temperature to obtain solution. This toluene solution was used to prepare the high molecular weight protonated ammonium bromide charge director described in Example III.

The above charges of initiator and monomers provide an $M_n$ and average degree of polymerization (DP) for each block. For the EHMA nonpolar B block, the charged $M_n$ is 76,852 and the DP is 387.5 and for the DMAEMA polar A block, the charged $M_n$ is 16,667 and the DP is 106. The charged total AB diblock $M_n$ is therefore 93,519. $^1$H-NMR analysis was obtained on a fraction of a 1 to 2 gram sample of this high molecular weight base polymer solid isolated by rotoevaporating the toluene solvent at the same rotoevaporation conditions described above. $^1$H-NMR analysis of a 7.6 percent (g/dl) $CDCl_3$ solution of the copolymer indicated 79.5 mole percent (83.0 weight percent) EHMA and 20.5 mole percent (17.0 weight percent) DMAEMA.

CONTROL 2

Very Low Molecular Weight Base Polymer (Charged $M_n$ of 1973)

There was selected a sequential Group Transfer Polymerization (GTP) of 2-ethylhexyl methacrylate (EHMA) and 2-dimethylaminoethyl methacrylate (DMAEMA) to prepare the low molecular weight AB diblock base polymer, poly [2-ethylhexyl methacrylate (B block)-co-N,N-dimethylamino-N-ethyl methacrylate (A block)]. This low molecular weight AB diblock base polymer was then used to prepare the very low molecular weight protonated ammonium bromide AB diblock copolymer charge director, poly[2-ethylhexyl methacrylate (B block)-co-N,N-dimethyl-N-ethyl methacrylate ammonium bromide (A block)], described in Control 6.

To a 2 liter 3-neck round bottom flask equipped with a magnetic stirring football, an Argon inlet and outlet and a neutral alumina (150 grams) column were charged, through the alumina column later to be replaced by a rubber septum, which alumina column along with the reactor was maintained under a positive Argon flow and sealed from the atmosphere, 415 grams (2.093 mole) of freshly distilled 2-ethylhexyl methacrylate (EHMA) monomer. Next, 500 milliliters of freshly distilled tetrahydrofuran solvent, distilled from sodium benzophenone, were rinsed through the same alumina column into the polymerization vessel. Subsequently, the GTP initiator, 52 milliliters of methyl trimethylsilyl dimethylketene acetal (44.62 grams; 0.25595 mole) were syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.50 milliliter of a 0.3 molar solution of tetrabutylammonium acetate (catalyst) in the same dry tetrahydrofuran was syringed into the polymerization vessel. About 0.5 hour after the mild exotherm peaked, there were added 90 grams (0.57246 mole) of freshly distilled 2-dimethylaminoethyl methacrylate monomer through the alumina column and then an additional 0.5 milliliter of 0.3 molar solution of tetrabutylammonium acetate (catalyst). The solution was magnetically stirred for 18 hours at ambient temperature. Then the tetrahydrofuran solvent was stripped with a rotoevaporator (4 hours at 40 to 60 millimeters Hg at 50° to 60° C.) and sufficient toluene solvent was added to the solid residue to complete the solvent exchange and to give a 50.63 weight percent toluene solution of the very low molecular weight base polymer. The residual solid was generally stirred with toluene for about 16 to 18 hours at ambient temperature to obtain solution. This toluene solution was used to prepare the very low molecular weight protonated ammonium bromide charge director described in Control 6.

The above charges of initiator and monomers provide an $M_n$ and average degree of polymerization (DP) for each block. For the EHMA nonpolar B block, the charged $M_n$ is 1,621 and the DP is 8.18 and for the DMAEMA polar A block, the charged $M_n$ is 352 and the DP is 2.24. The charged total AB diblock $M_n$ is therefore 1,973. $^1$H-NMR analysis was obtained on a fraction of a 1 to 2 gram sample of this low molecular weight base polymer solid isolated by rotoevaporating the toluene solvent at the same rotoevaporation conditions described above. $^1$H-NMR analysis of a 21.2 percent (g/dl) $CDCl_3$ solution of the copolymer indicated 84.0 mole percent (86.88 weight percent) EHMA and 16.0 mole percent (13.12 weight percent) DMAEMA. Nonaqueous titration of the tertiary aliphatic amine group in each DMAEMA repeat unit of the polar A block of this low molecular weight base polymer indicated a composition very similar to that of the $^1$H-NMR analysis: 84.76 mole percent (87.52 weight percent) EHMA by difference and 15.24 mole percent (12.48 weight percent) DMAEMA by direct titration. The nonaqueous titration composition was based on the finding of 0.786 milliequivalent of amine per gram of solid base polymer. The weight percent DMAEMA repeat units (12.48 weight percent) from the nonaqueous titration in this very low molecular weight base polymer was used in Control 6 to calculate the required amount of 48 percent hydrobromic acid required to make the charge director.

CONTROL 3

Low to Mid-Molecular Weight Base Polymer (Charged $M_n$ of 23315)

There was selected a sequential Group Transfer Polymerization (GTP) of 2-ethylhexyl methacrylate (EHMA) and 2-dimethylaminoethyl methacrylate (DMAEMA) to prepare the low-mid molecular weight AB diblock base polymer, poly[2-ethylhexyl methacrylate (B block)-co-N,N-dimethylamino-N-ethyl methacrylate (A block)]. This low-mid molecular weight AB diblock base polymer was then used to prepare the low-mid molecular weight protonated ammonium bromide AB diblock copolymer charge director, poly [2-ethylhexyl methacrylate (B block)-co-N,N-dimethyl-N-ethyl methacrylate ammonium bromide (A block)].

To a 100 milliliter round bottom flask equipped with a magnetic stirring football, an Argon inlet and outlet, and a neutral alumina column was charged, through the alumina column, later to be replaced by a rubber septum; which alumina column along with the reactor was maintained under a positive Argon flow and sealed from the atmosphere, 20 milliliters of freshly distilled (from sodium benzophenone) tetrahydrofuran (THF) solvent, 9.00 grams (0.0572 mole) of freshly distilled 2-dimethylaminoethyl methacrylate monomer and an additional 8 milliliters of the same THF to rinse down the column. Then, 0.2 milliliter of a 0.033 molar solution of tetrabutylammonium acetate (catalyst) in the same dry tetrahydrofuran was syringed into the polymerization vessel. Then 0.44 milliliter (0.002166 mole) of initiator, methyl trimethylsilyl dimethylketene acetal, was syringed into the reactor. The acetal was originally vacuum distilled, and a middle fraction was collected and stored (under Argon) for polymerization initiation purposes. About one hour after the addition of the ketene acetal initiator, the mild exotherm began to subside. After an additional 0.5 to 1.0 hour, the contents of the 100 milliliter reactor were transferred with a dry syringe into a second reactor (500 milliliter round bottom flask similarly equipped as the first reactor) which second reactor contained 41.5 grams (0.2093 mole) of freshly distilled 2-ethylhexyl methacrylate monomer and 50 milliliters of freshly distilled tetrahydrofuran solvent also at ambient temperature. The combined reactor contents were allowed to stir for 18 hours at ambient temperature. The tetrahydrofuran solvent was then stripped with a rotoevaporator (1 hour at 40 to 60 millimeters Hg at 50° to 60° C.) and sufficient toluene solvent was added to the solid residue to complete the solvent exchange and to give a 53.16 weight percent toluene solution of the low-mid molecular weight base polymer. The residual solid was generally stirred with toluene for about 16 to 18 hours at ambient temperature to obtain solution. This toluene solution was used to prepare the low-mid molecular weight protonated ammonium bromide charge director described in Control 5.

The above charges of initiator and monomers provide an $M_n$ and average degree of polymerization (DP) for each block. For the EHMA nonpolar B block, the charged $M_n$ is 19,160 and the DP is 96.6, and for the DMAEMA polar A block, the charged $M_n$ is 4,155 and the DP is 26.4. The charged total AB diblock $M_n$ is therefore 23,315. A $^1$H-NMR analysis was performed on a fraction of a 1 to 2 gram sample of this low-mid molecular weight base polymer solid isolated by rotoevaporating the toluene solvent at the same rotoevaporation conditions described above. $^1$H-NMR analysis of about a 15.0 percent (g/dl) $CDCl_3$ solution of the copolymer indicated 76.9 mole percent (80.76 weight percent) EHMA and 23.1 mole percent (19.24 weight percent) DMAEMA. The weight percent DMAEMA in this low-mid molecular weight base polymer was used in Control 5 to calculate the required amount of 48 percent hydrobromic acid required to make the charge director.

CONTROL 4

Mid-Molecular Weight Base Polymer (Charged $M_n$ of 46640)

There was selected a sequential Group Transfer Polymerization (GTP) of 2-ethylhexyl methacrylate (EHMA) and 2-dimethylaminoethyl methacrylate (DMAEMA) to prepare the mid molecular weight AB diblock base polymer, poly [2-ethylhexyl methacrylate (B block)-co-N,N-dimethylamino-N-ethyl methacrylate (A block)]. This mid-molecular weight AB diblock base polymer was then used to prepare the mid-molecular weight protonated ammonium bromide AB diblock copolymer charge director, poly[2-ethylhexyl methacrylate (B block)-co-N,N-dimethyl-N-ethyl methacrylate ammonium bromide (A block)], described in Control 7.

To a 100 milliliter round bottom flask equipped with a magnetic stirring football, an Argon inlet, and outlet and a neutral alumina column were charged, through the alumina column, later to be replaced by a rubber septum; which alumina column along with the reactor was maintained under a positive Argon flow and sealed from the atmosphere, 20 milliliters of freshly distilled (from sodium benzophenone) tetrahydrofuran (THF) solvent, 9.00 grams (0.0572 mole) of freshly distilled 2-dimethylaminoethyl methacrylate monomer and an additional 8 milliliters of the same THF to rinse down the column. Then, 0.2 milliliter of a 0.033 molar solution of tetrabutylammonium acetate (catalyst) in the same dry tetrahydrofuran was syringed into the polymerization vessel. Then, 0.22 milliliter (0.001083 mole) of initiator, methyl trimethylsilyl dimethylketene acetal, was syringed into the reactor. The acetal was originally vacuum distilled and a middle fraction was collected and stored (under Argon) for polymerization initiation purposes. About one hour after the addition of the ketene acetal initiator, the mild exotherm began to subside. After an additional hour, the contents of the 100 milliliters reactor were transferred with a dry syringe into a second reactor (500 milliliter round bottom flask similarly equipped as the first reactor) which second reactor contained 41.5 grams (0.2093 mole) of freshly distilled 2-ethylhexyl methacrylate monomer and 50 milliliters of freshly distilled tetrahydrofuran solvent also at ambient temperature. The combined reactor contents were allowed to stir for 18 hours at ambient temperature. Then, the tetrahydrofuran solvent was stripped with a rotoevaporator (1 hour at 40 to 60 millimeters Hg at 50° to 60° C.) and sufficient toluene solvent was added to the solid residue to complete the solvent exchange and to give a 48.14 weight percent toluene solution of the mid-molecular weight base polymer. The residual solid was generally stirred with toluene for about 16 to 18 hours at ambient temperature to obtain solution. This toluene solution was used to prepare the mid-molecular weight protonated ammonium bromide charge director described in Control 7.

The above charges of initiator and monomers provide an $M_n$ and average degree of polymerization (DP) for each block. For the EHMA nonpolar B block, the charged $M_n$ is 38,325, and the DP is 193.3 and for the DMAEMA polar A block, the charged $M_n$ is 8,311 and the DP is 52.9. The charged total AB diblock $M_n$ is therefore 46,636. A nonaqueous titration was performed on a fraction of a 1 to 2 gram sample of this mid-molecular weight base polymer solid isolated by rotoevaporating the toluene solvent at the same rotoevaporation conditions described above. Nonaqueous titration indicated the presence of 80.22 mole percent (83.65 weight percent) of EHMA and 19.78 mole percent (16.35 weight percent) of DMAEMA. The nonaqueous titration composition was based on the finding of 1.040 millequivalents of amine per gram of solid base polymer. The weight percent DMAEMA in this mid-molecular weight base polymer was used in Control 7 to calculate the required amount of 48 percent hydrobromic acid required to make the charge director.

CONTROL 5

Low to Mid-Moleulcar Weight Charge Director

Preparation of the low mid-molecular weight protonareal ammonium bromide AB diblock copolymer charge director, poly[2-ethylhexyl methacrylate (B block)-co-N,N-dimethyl-N-ethyl methacrylate ammonium bromide (A block)], from low mid-molecular weight base polymer (charged $M_n$ of 23,315), poly[2-ethylhexyl methacrylate (B block)-co-N,N-dimethylamino-N-ethyl methacrylate (A block)], prepared in Control 3 and aqueous hydrogen bromide.

To a 250 milliliter Erlenmeyer flask were added 20.00 grams of a 53.16 weight percent toluene solution of the low mid-molecular weight AB diblock copolymer (10.63 grams of copolymer and 9.37 grams of toluene) prepared in Control 3 as poly(2-ethylhexyl methacrylate-co-N,N-dimethylamino-N-ethyl methacrylate). The AB diblock copolymer is comprised of 19.24 weight percent of 2-dimethylaminoethyl methacrylate (DMAEMA) repeat units and 80.76 weight percent of 2-ethylhexyl methacrylate (EHMA) repeat units. The 10.63 grams of AB diblock copolymer contains 2.05 grams (0.013039 mole) of DMAEMA repeat units. To this magnetically stirred AB diblock copolymer toluene solution at about 22° C. were added an additional 42.34 grams of toluene, 4.10 grams of methanol, and 2.15 grams (0.01278 mole of HBr) of 48 percent aqueous hydrobromic acid (Aldrich). The charged solids level is 17.0 weight percent assuming a quantitative conversion of the targeted 98 mole percent DMAEMA repeat units present in the low mid-molecular weight base polymer to the HBr salt. This solution was magnetically stirred for 16 to 18 hours at ambient temperature to give a slightly viscous low mid-molecular weight protonated ammonium bromide AB diblock copolymer charge director solution. To this charge director solution were added 201.97 grams of NORPAR 15® to give a 5 weight percent (based on the corresponding starting weight of the AB diblock copolymer from Control 3) charge director solution after toluene and methanol rotoevaporation. Toluene and methanol were rotoevaporated at 55° to 60° C. for about 1.0 hour at 40 to 60 millimeters Hg. The 5 weight percent NORPAR 15® solution of poly(2-ethylhexyl methacrylate-co-N,N-dimethyl-N-ethyl methacrylate ammonium bromide) had a conductivity of 170 pmhos/centimeter and was used to charge liquid toner.

CONTROL 6

Very Low Molecular Weight Charge Director

Preparation of the very low molecular weight protonated ammonium bromide AB diblock copolymer charge director, poly[2-ethylhexyl methacrylate (B block)-co-N,N-dimethyl-N-ethyl methacrylate ammonium bromide (A block)], from the very low molecular weight base polymer (charged $M_n$ of 1,973), poly[2-ethylhexyl methacrylate (B block)-co-N,N-dimethylamino-N-ethyl methacrylate (A block)], prepared in Control 2 and aqueous hydrogen bromide.

To a 250 milliliter Erlenmeyer flask were added 20.00 grams of a 50.63 weight percent toluene solution of the very low molecular weight AB diblock copolymer (10.13 grams of copolymer and 9.87 grams of toluene) prepared in Control 2 as poly(2-ethylhexyl methacrylate-co-N,N-dimethylamino-N-ethyl methacrylate). The AB diblock copolymer was comprised of 12.48 weight percent of 2-dimethylaminoethyl methacrylate (DMAEMA) repeat units and 87.52 weight percent of 2-ethylhexyl methacrylate (EHMA) repeat units. The 10.13 grams of AB diblock copolymer contained 1.26 grams (0.00801 mole) of DMAEMA repeat units. To this magnetically stirred AB diblock copolymer toluene solution at about 2° C. were added an additional 38.20 grams of toluene, 3.82 grams methanol, and 1.33 grams (0.00785 mole of HBr) of 48 percent aqueous hydrobromic acid (Aldrich). The charged solids level was 17.0 weight percent assuming a quantitative conversion of the targeted 98 mole percent of DMAEMA repeat units present in the very low molecular weight base polymer to the HBr salt. This solution was magnetically stirred for 16 to 18 hours at ambient temperature to give the very low molecular weight non-viscous solution of protonated ammonium bromide AB diblock charge director solution. The solution was then diluted with NORPAR 15® (192.47 grams) to give a 5 weight percent (based on the corresponding starting weight of the AB diblock copolymer from Control 2) charge director solution after toluene and methanol rotoevaporation. Toluene and methanol were rotoevaporated at 55° to 60° C. for 1 hour at 40 to 50 millimeters Hg. The 5 weight percent NORPAR 15® solution of poly(2-ethylhexyl methacrylate-co-N,N-dimethyl-N-ethyl methacrylate ammonium bromide) had a conductivity of 2,850 pmhos/centimeters and was used to charge liquid toner.

CONTROL 7

Mid-Molecular Weight Charge Director

Preparation of the mid-molecular weight protonated ammonium bromide AB diblock copolymer charge director, poly[2-ethylhexyl methacrylate (B block)-co-N,N-dimethyl-N-ethyl methacrylate ammonium bromide (A block)], from mid-molecular weight base polymer (charged $M_n$ of 46,636), poly[2-ethylhexyl methacrylate (B biock)-co-N,N-dimethylamino-N-ethyl methacrylate (A block)], prepared in Control 4 and aqueous hydrogen bromide.

To a 125 milliliter Erlenmeyer flask were added 20.00 grams of a 46.21 weight percent toluene solution of the mid-molecular weight AB diblock copolymer (9.24 grams of copolymer and 10.76 grams of toluene) prepared from poly(2-ethylhexyl methacrylate-co-N,N-dimethylamino-N-ethyl methacrylate) described in Control 4. The AB diblock copolymer was comprised of 16.35 weight percent of 2-dimethylaminoethyl methacrylate (DMAEMA) repeat units and 83.65 weight percent of 2-ethylhexyl methacrylate (EHMA) repeat units. The 9.24 grams of AB diblock copolymer contained 1.51 grams (0.0096 mole) of DMAEMA repeat units. To this magnetically stirred AB diblock copolymer toluene solution at about 22° C. were added an additional 47.53 grams of toluene, 4.62 grams of methanol, and 1.59 grams (0.0094 mole of HBr) of 48 percent aqueous hydrobromic acid (Aldrich). The charged solids level was 13.6 weight percent assuming a quantitative conversion of the targeted 98 mole percent of DMAEMA repeat units present in the mid molecular weight base polymer to the HBr salt. This solution was magnetically stirred for 21 hours at ambient temperature to give a viscous mid-molecular weight protonated ammonium bromide AB diblock copolymer charge director solution. To 36.87 grams of this charge director solution (one-half of the total weight of the charge director solution) were added 87.78 grams of NORPAR 15® to give a 5 weight percent (based on one-half the corresponding starting weight of the AB diblock copolymer from Control 4) charge director solution after toluene and methanol rotoevaporation. Toluene and methanol were rotoevaporated at 50° to 55° C. for 2.5 hours at 75 to 80 millimeters Hg. The 5 weight percent NORPAR 15® solution of poly(2-ethylhexyl methacrylate-co-N,N-dimethyl-N-ethyl methacrylate ammonium bromide) had a conductivity of 57 pmhos/centimeters and was used to charge liquid toner.

CONTROL 8

Low Molecular Weight Charge Director

Preparation of the low molecular weight protonareal ammonium bromide AB diblock copolymer charge director, poly[2-ethylhexyl methacrylate (B block)-co-N,N-dimethyl-N-ethyl methacrylate ammonium bromide (A block)], from low molecular weight base polymer (charged $M_n$ of 3,945), poly[2-ethylhexyl methacrylate (B block)-co-N,N-dimethylamino-N-ethyl methacrylate (A block)], prepared in Control 1 and aqueous hydrogen bromide.

To a 4.0 liter Edenmeyer flask were added 637.1 grams of a 50.86 weight percent toluene solution of the low molecular weight AB diblock copolymer (324.0 grams of copolymer and 313.1 grams of toluene) prepared from poly(2-ethylhexyl methacrylate-co-N,N-dimethylamino-N-ethyl methacrylate) described in Control 1. The AB diblock copolymer was comprised of 18.25 weight percent of 2-dimethylaminoethyl methacrylate (DMAEMA) repeat units and 81.75 weight percent of 2-ethylhexyl methacrylate (EHMA) repeat units. The 324.0 grams of AB diblock copolymer contained 59.1 grams (0.376 mole) of DMAEMA repeat units. To this magnetically stirred AB diblock copolymer toluene solution at about 20° C. were added an additional 324.0 grams of toluene, 50.5 grams of methanol, and 62.1 grams (0.368 mole of HBr) of 48 percent aqueous hydrobromic acid (Aldrich). The charged solids level was 32.95 weight percent, assuming a quantitative conversion of the targeted 98 mole percent DMAEMA repeat units present in the low molecular weight base polymer, to the HBr salt. This solution was magnetically stirred for about 66 hours at ambient temperature to give a low molecular weight protonated ammonium bromide AB diblock charge director solution of increased viscosity versus the solution of reactants at time zero. The moderately viscous solution was then diluted with NORPAR 15® (6, 156.6 grams) to give a 5 weight percent (based on the corresponding starting weight of the AB diblock copolymer from Control 1) charge director solution after toluene and methanol rotoevaporation. Toluene and methanol were rotoevaporated in 0.5 liter batches at 50° to 60° C. for 1.0 to 1.5 hours at 40 to 60 millimeters Hg. The 5 weight percent NORPAR 15® solution batches of poly(2-ethylhexyl methacrylate-co-N,N-dimethyl-N-ethyl methacrylate ammonium bromide) had conductivities in the range of 1,970 to 2,110 pmhos/centimeters and were used to charge liquid toner.

EXAMPLE III

High Molecular Weight Charge Director

Preparation of the high molecular weight protonareal ammonium bromide AB diblock copolymer charge director, poly[2-ethylhexyl methacrylate (B block)-co-N,N-dimethyl-N-ethyl methacrylate ammonium bromide (A block)], from high molecular weight base polymer (charged $M_n$ of 93,519), poly[2-ethyihexyl methacrylate (B block)-co-N,N-dimethylamino-N-ethyl methacrylate (A block)], prepared in Example II and aqueous hydrogen bromide.

To a 250 milliliter Erlenmeyer flask were added 20.00 grams of a 48.14 weight percent toluene solution of the high molecular weight AB diblock copolymer (9.63 grams of copolymer and 10.37 grams of toluene) prepared from poly(2-ethylhexyl methacrylate-co-N,N-dimethylamino-N-ethyl methacrylate) described in Example II. The AB diblock copolymer was comprised of 17.0 weight percent of 2-dimethylaminoethyl methacrylate (DMAEMA) repeat units and 83.0 weight percent of 2-ethylhexyl methacrylate (EHMA) repeat units. The 9.63 grams of AB diblock copolymer contained 1.64 grams (0.0104 mole) of DMAEMA repeat units. To this magnetically stirred AB diblock copolymer toluene solution at about 20° C. were added an additional 50.31 grams of toluene, 4.81 grams of methanol, and 0.82 gram (0.0102 mole of HBr) of 48 percent aqueous hydrobromic acid (Aldrich). The charged solids level was 13.6 weight percent, assuming a quantitative conversion of the targeted 98 mole percent DMAEMA repeat units present in the high molecular weight base polymer, to the HBr salt. This solution was magnetically stirred for 16 to 18 hours at ambient temperature to give a very viscous but still magnetically stirrable high molecular weight protonated ammonium bromide AB diblock charge director solution. The viscous solution was then diluted with NORPAR 15® (182.97 grams) to give a 5 weight percent (based on the corresponding starting weight of the AB diblock copolymer from Example II) charge director solution after toluene and methanol rotoevaporation. Toluene and methanol were rotoevaporated at 60° to 65° C. for 1 hour at 40 to 50 millimeters Hg. The 5 weight percent of NORPAR 15® solution of poly(2-oethylhexyl methacrylate-co-N,N-dimethyl-N-ethyl methacrylate ammonium bromide) had a conductivity of only 5.0 pmhos/centimeter and was used to charge liquid toner.

CONTROL 9

Cyan Liquid Developers Charged with the Low Molecular Weight Protonated Ammonium Bromide AB Diblock Copolyomer Charge Director Cyan liquid toner dispersions were prepared by selecting 27.74 grams of liquid toner concentrate (7.21 percent solids in NORPAR 15®) from Example I and adding to it sufficient NORPAR 15® and 5 percent low molecular weight (charged $M_n$ of 3,945) protonated ammonium bromide AB diblock charge director, poly[2-ethylhexyl methacrylate (B block)-co-N,N-dimethyl-N-ethyl methacrylate ammonium bromide (A block)], from Control 8 to provide 1 percent solids wherein solids include resin, charge adjuvant, and pigment liquid toner dispersions containing 10, 30, 50, 70, and 90 milligrams or 1, 3, 5, 7 and 9 percent charge director per gram of toner solids (Controls 9A to 9E). The 5 percent low molecular weight protonated ammonium bromide AB diblock charge director was prepared from the low molecular weight base polymer of Control 1. After 1, 7, 14, and 21 days of equilibration, mobility and conductivity were measured for these 1 percent liquid toners to determine the toner charging rate and level. These values were compared to mobility and conductivity values obtained for the 1 percent cyan liquid toners described in Example IV containing the high molecular weight protonated ammonium bromide AB diblock charge director. Table 1 in Example IV contains 200 gram formulations for both sets of cyan liquid toners or developers charged with the low and high molecular weight protonated ammonium bromide AB diblock copolymer charge directors. Table 2 in Example :IV contains the corresponding mobility and conductivity values for both sets of cyan liquid toners or developers.

EXAMPLE IV

Cyan Liquid Developers Charged with the High Molecular Weight Protonated Ammonium Bromide AB Diblock Copolymer Charge Director Cyan liquid toner dispersions were prepared by selecting 27.74 grams of liquid toner concentrate (7.21 percent solids in NORPAR 15®) from Example I and adding to it sufficient NORPAR 15® and 5 percent high molecular weight (charged $M_n$ of 93,519) protonated ammonium bromide AB diblock charge director, poly[2-ethylhexyl methacrylate (B block)-co-N,N-dimethyl-N-ethyl methacrylate ammonium bromide (A block)], from Example III to provide 1 percent solids wherein solids include resin, charge adjuvant, and pigment liquid toner dispersions containing 30, 60, 94, 120, and 150 milligrams or 3, 6, 9, 4, 12 and 15 percent charge director per gram of toner solids (Examples IVA to IVE). The 5 percent high molecular weight protonated ammonium bromide AB diblock charge director was prepared from the high molecular weight base polymer of Example II. After 1, 3, 7, and 13 days of equilibration, mobility and conductivity were measured for these 1 percent liquid toners to determine the toner charging rate and level. These values were compared to mobility and conductivity values obtained for the 1 percent cyan liquid toners described in Control 9. Table 1 contains 200 gram formulations for both sets of cyan developers charged with the low and high molecular weight protonated ammonium bromide AB diblock copolymer charge directors. Table 2 contains the corresponding mobility and conductivity values for both sets of cyan liquid toners or developers.

At all charge director concentrations (mg charge director/g toner solids) studied, FIG. 1 illustrates the consistently lower conductivities obtained after 13 days for cyan developers, prepared from the cyan liquid toner concentrate described in Example I, charged with the high $M_n$ AB diblock protonated ammonium bromide (salt) copolymer charge director of the present invention, prepared in Example III from the high molecular weight base polymer described in Example II versus cyan developers, also prepared from the cyan liquid toner concentrate described in Example I, charged with the corresponding low $M_n$ AB diblock protonated ammonium bromide (salt) copolymer charge director after 14 days, and prepared in Control 8 from the low molecular weight base polymer described in Control 1.

Figure 2:
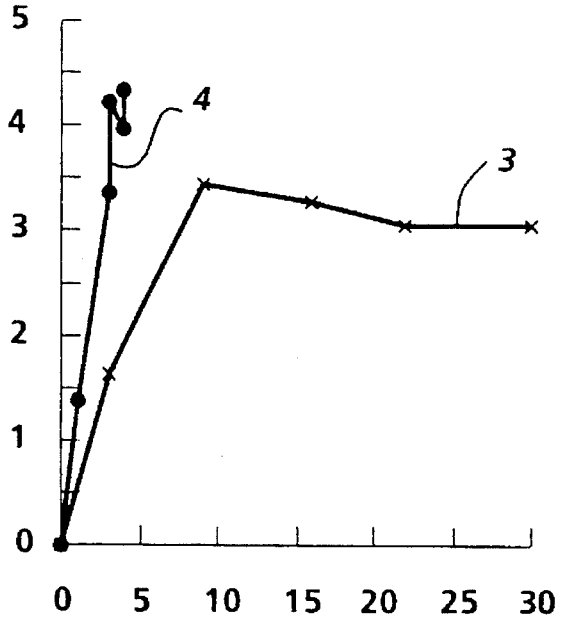
In FIG. 2, there is presented data from Example IV and Control 9, mobility versus conductivity after two weeks aging of cyan developers shaped with either low or high molecular weight AB diblock protonated (salt) ammonium bromide copolymer charge directors wherein line 3 represents the mobility ($m^2/Vs$) of developers containing low molecular weight charge director controls 9A to 9E, and line 4 represents the mobility ($m^2/Vs$) of developers containing high molecular weight charge director, reference Examples IVA to IVE.

FIG. 2 illustrates that cyan developers charged with increasing amounts of the high molecular weight AB diblock protonated ammonium bromide (salt) copolymer charge director level off at mobilities equal to or greater than 4.0 $m^2/Vs$ after 13 days without any significant further increase in developer conductivity, whereas the corresponding developers charged with increasing amounts of the low molecular weight AB diblock protonated ammonium bromide (salt) copolymer charge director plateau at mobilities equal to or less than 3.5 $m^2/Vs$ with steadily increasing conductivity. Low ink conductivities are considered necessary for optimum image density and resolution thus making developers charged with high molecular weight AB diblock protonated ammonium bromide copolymer charge directors advantageous over developers charged with the corresponding low molecular weight AB diblock protonated ammonium bromide copolymer charge directors.

Figure 3:
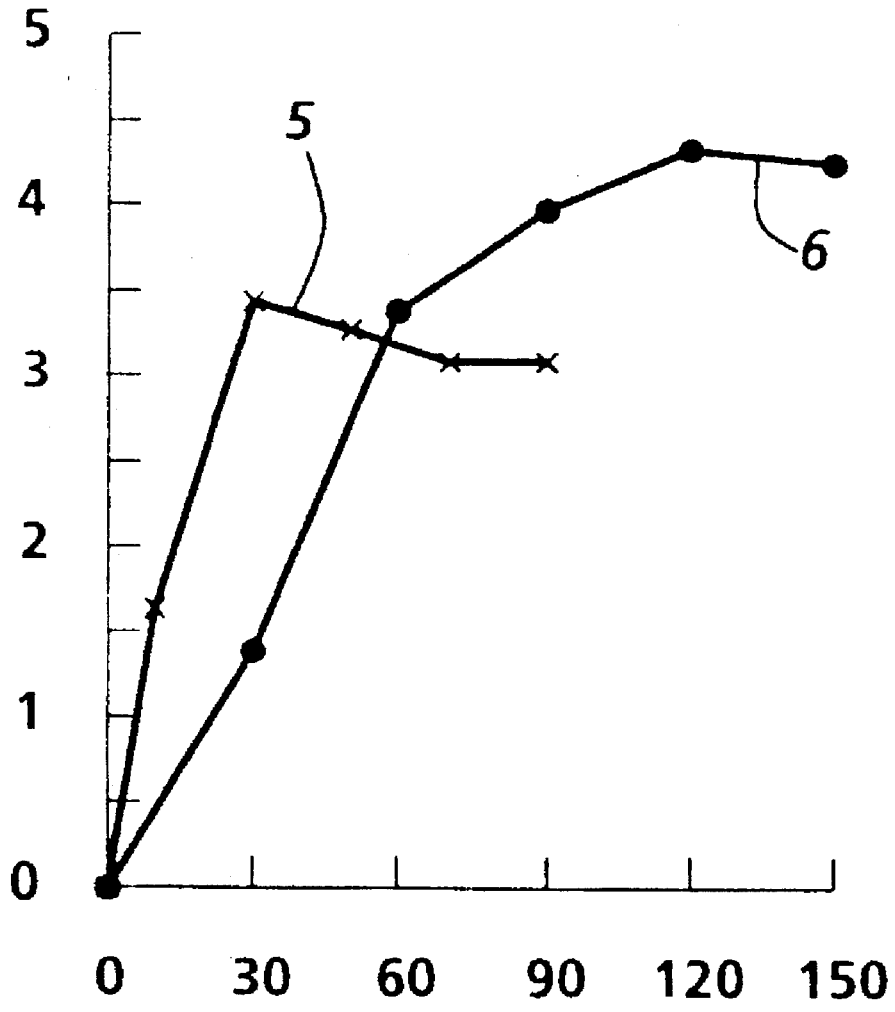
FIG. 3 contains data from Example IV and Control 9, mobility versus charge director concentration after two weeks aging of cyan developers charged with either low or high molecular weight AB diblock protonated (salt) ammonium bromide copolymer charge directors, and wherein line 5 represents the mobility (E-10 $m^2/Vs$) of developers containing low molecular weight charge director controls 9A to 9E, and line 6 represents the mobility (E-10 $m^2/Vs$) of developers containing high molecular weight charge director, reference Examples IVA to IVE.

FIG. 3 illustrates that high molecular weight AB diblock protonated ammonium bromide copolymer charge director advantage, versus the low molecular weight variety, because the option of charging toner particles to higher charging levels with higher concentrations of charge director results for the high molecular weight charge director.

TABLE 1

Cyan Liquid Developer Formulations Charged with Low and High Molecular Weight Protonated Ammonium Bromide AB Diblock Copolymer Charge Directors

| Developer ID: Control or Example No. | Grams Toner Concentrate From Example I | Grams Added NORPAR 15 | Grams Added 5% Charge Director (CD) in NORPAR 15 | CD Preparation Example No. & CD Level in mg CD/g Toner Solids |
|---|---|---|---|---|
| Control 9A | 27.74 | 171.86 | 0.40 | Control 8: 10/1 Low MW |
| Example IVA | | 171.06 | 1.20 | Example III: 30/1 High MW |
| Control 9B | 27.74 | 171.06 | 1.20 | Control 8: 30/1 Low MW |
| Example IVB | | 169.86 | 2.40 | Example III: 60/1 High MW |
| Control 9C | 27.74 | 170.26 | 2.00 | Control 8: 50/1 Low MW |
| Example IVC | | 168.66 | 3.74 | Example III: 94/1 High MW |
| Control 9D | 27.74 | 169.46 | 2.80 | Control 8: 70/1 Low MW |
| Example IVD | | 167.46 | 4.80 | Example III: 120/1 High MW |
| Control 9E | 27.74 | 168.66 | 3.60 | Control 8: 90/1 Low MW |
| Example IVE | | 166.26 | 6.00 | Example III: 150/1 High MW |

EXAMPLE V

SYNTHESIS OF CHARGE ADJUVANT: Hydroxy Bis[3,5-Tertiary Butyl Salicylic] Aluminate Monohydrate Elevated Temperature Synthesis: To a solution of 12 grams (0.3 mole) NaOH in 500 milliliters of water were added 50 grams (0.2 mole) di-tertbutyl salicylic acid. The resulting mixture was heated to 60° C. to dissolve the acid. A second solution was prepared from dissolving 33.37 grams (0.05 mole) of aluminum sulfate, $Al_2(SO_4)_3.18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis[3,5-tertiary butyl salicylic] aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of greater than 300° C. When a sample, about 50 grams, of the hydroxy bis[3,5-tertiary butyl salicylic] aluminate monohydrate was analyzed for water of hydration by Karl-Fischer titration after drying for an additional 24 hours at 100° C. in a vacuum, the sample contained 2.1 percent weight of water. The theoretical value calculated for a monohydrate is 3.2 percent weight of water.

Infrared spectra of the above product hydroxy bis[3,5-tertiary butyl salicylic] aluminate monohydrate indicated the absence of peaks characteristic of the starting material di-tert-butyl salicylic acid and indicated the presence of a Al-OH band characteristic at 3,660 $cm^{-1}$ and peaks characteristic of water of hydration.

NMR analysis for the hydroxy aluminate complex was obtained for carbon, hydrogen and aluminum nuclei, and were all consistent with the above prepared monohydrate.

Elemental Analysis Calculated for $C_{30}H_{41}O_7Al$: C, 66.25; H, 7.62; Al, 5.52.

Calculated for $C_{30}H_{41}O_7Al.1H_2O$: C, 64.13; H, 7.74; Al, 4.81.

Found: C, 64.26; H, 8.11; Al, 4.67.

Ambient Temperature Synthesis: The elevated temperature synthetic procedure described above was repeated with the exception that the mixing of the two solutions and subsequent stirring was accomplished at room temperature, about 25° C. The product was isolated and dried as in the elevated temperature synthetic procedure, and was identified as the above hydroxy aluminum complex hydrate by IR.

TABLE 2

Mobility and Conductivity Results for Cyan Liquid Developers Charged with Low and High Molecular Weight Protonated Ammonium Bromide AB Diblock Copolymer Charge Directors

| Developer ID: Control or Example No. | Aging: Time in Days | CD Level: mg CD/g Toner Solids | Mobility: $E^{-10}$ $m^2/Vs$ | Cond.: ps/cm | COMMENTS |
|---|---|---|---|---|---|
| Control 9A | 1 | 10/1 Low | −2.25 | 4 | Moderate |
| | 7 | MW AB | −1.89 | 4 | Charging & |
| | 14 | Diblock | −1.63 | 3 | Low |
| | 21 | Copolymer | −1.68 | 3 | Conductivity |
| Control 9B | 1 | 30/1 Low | −3.00 | 11 | High Charging |
| | 7 | MW AB | −3.36 | 10 | & Moderate |
| | 14 | Diblock | −3.45 | 9 | Conductivity |
| | 21 | Copolymer | −3.47 | 10 | |
| Control 9C | 1 | 50/1 Low | −3.04 | 18 | High Charging |
| | 7 | MW AB | −3.19 | 17 | & High |
| | 14 | Diblock | −3.29 | 16 | Conductivity |
| | 21 | Copolymer | −3.54 | 17 | |
| Control 9D | 1 | 70/1 Low | −3.16 | 26 | High Charging |
| | 7 | MW AB | −3.40 | 25 | & Very High |
| | 14 | Diblock | −3.08 | 22 | Conductivity |
| | 21 | Copolymer | −3.58 | 24 | |
| Control 9E | 1 | 90/1 Low | −3.19 | 33 | High Charging |
| | 7 | MW AB | −3.38 | 33 | & Very High |
| | 14 | Diblock | −3.08 | 30 | Conductivity |
| | 21 | Copolymer | −3.49 | 33 | |
| Example IVA | 1 | 30/1 High | −1.87 | 2 | Low Charging |
| | 3 | MW AB | −1.72 | 2 | & Very Low |
| | 7 | Diblock | −1.24 | 1 | Conductivity |
| | 13 | Copolymer | −1.38 | 1 | |
| Example IVB | 1 | 60/1 High | −2.97 | 2 | High Charging |
| | 3 | MW AB | −3.31 | 3 | & Low |
| | 7 | Diblock | −2.77 | 2 | Conductivity |
| | 13 | Copolymer | −3.38 | 3 | |
| Example IVC | 1 | 94/1 High | −3.30 | 3 | Very High |
| | 3 | MW AB | −3.94 | 3 | Charging & |
| | 7 | Diblock | −3.75 | 3 | Low |
| | 13 | Copolymer | −3.97 | 4 | Conductivity |
| Example IVD | 1 | 120/1 High | −3.60 | 3 | Very High |
| | 3 | MW AB | −4.02 | 4 | Charging & |
| | 7 | Diblock | −3.89 | 4 | Low |
| | 13 | Copolymer | −4.33 | 4 | Conductivity |
| Example IVE | 1 | 150/1 High | −3.67 | 3 | Extremely High |
| | 3 | MW AB | −4.14 | 4 | Charging & |
| | 7 | Diblock | −4.40 | 4 | Low |
| | 13 | Copolymer | −4.24 | 3 | Conductivity |

EXAMPLE VI

Series-Capacitor Technique

The electrical properties of liquid developers can be reviewed using a series-capacitor method, which is a well-established method for determining the dielectric relaxation time in partially conductive materials as, for example, might be found in "leaky" capacitors.

Two series-capacitors can be used. One is comprised of a dielectric layer (MYLAR®) which corresponds to the photoreceptor, the other is comprised of a layer of liquid (ink). Although a constant bias voltage is maintained across the two capacitors, the voltage across the ink layer decays as the charged particles within it move. Measurement of the external currents allows the observation of the decay of voltage across the ink layer. Depending on the composition of the ink layer, this reflects the motion of charged species, in real time, as in the various, actual LID (Liquid Immersion Development) processes.

Application of a codeveloped theoretical analysis, together with a knowledge of the dielectric thicknesses of the MYLAR® and ink layers, the applied bias voltage and the observed current, provides information about the mobilities and densities of the charged species which in general are found to be time and field-dependent.

Three liquid developers of Example I were tested, all at 2 percent solids in NORPAR 15®. Example VIA was charged with low molecular charge director of Control 8 (48 milligrams of charge director per gram of ink solids); Example VIB was charged with medium molecular charge director of Control 7 (100 milligrams of charge director per gram of toner solids); and Example VIC was charged with high molecular weight charge director of Example III (100 milligrams of charge director per gram of toner solids). The results are provided in Table 3.

TABLE 3

| EXAMPLE | CHARGE DIRECTOR | TIME (SEC) | CURRENT (MICRO AMPS) |
|---|---|---|---|
| VIA | Control 8 | $1 \times 10^{-4}$ | 150 |
| VIA | Control 8 | $3 \times 10^{-4}$ | 200 |
| VIA | Control 8 | $6 \times 10^{-4}$ | 150 |
| VIB | Control 7 | $1 \times 10^{-4}$ | 3 |
| VIB | Control 7 | $3 \times 10^{-4}$ | 12 |
| VIB | Control 7 | $6 \times 10^{-4}$ | 30 |
| VIC | Example III | $1 \times 10^{-4}$ | 1 |
| VIC | Example III | $3 \times 10^{-4}$ | 5 |
| VIC | Example III | $6 \times 10^{-4}$ | 15 |

Examination of the data in Table 3 illustrates that the high molecular weight charge director provides an ink that delivers considerably less current than the inks charged with low and medium molecular weight charge director.

EXAMPLE VII

EXPERIMENTAL BACKGROUND

1. Charge Collection

These measurements were accomplished in a liquid cell configured as a plane parallel capacitor with plate separation of 211 microns and electrode area of 10 $cm^2$. A high voltage step was applied to the specimen cell from a customized computer controlled power supply and the time dependent current induced by the sweep out of charged micelies recorded using a Keithley 427 current amplifier and a Nicolet 4094B digital oscilloscope computer interfaced to receive synchronized timing pulses. Current integration to provide the net charge swept out of the contained miceller fluid and delivered to the electrodes by the field step was by conventional signal processing with computational algorithms.

2. AC Conductivity

These measurements accomplished as a function of frequency were effected in the liquid cell used for the pulsed field experiments described above, using a General Radio 1689M Digibridge operating under computer control. AC bias was maintained less than 1 volt at each frequency. The dielectric behavior of the miceller fluid was simultaneously analyzed from the in phase component of the AC response at each frequency. In the low frequency limit, AC conductivity provides the most reliable measure of the bulk microscopic conductivity in the fluid. An alternative estimate of bulk conductivity was provided by analyzing the transient response of the fluid to step field excitation. AC conductivity and step response measurements of conductivity were corroborative.

3. Micelief Drift Mobility:

Drift mobility measurements were made in conjunction with the analysis of charge collection with the apparatus already described herein. Average mobility of all charged species in the fluid was determined from the shape of the transient current response to an applied step using methods proposed in a sweep out model. Since conductivity is the product of charge density and drift mobility, redundancy in the combination of measurements described, it is believed, provides a self consistent check on the veracity of any given measurement procedure.

| Charge Director Molecular Weight ($M_n$) | Conductivity of 0.1% (by weight) Charge Director in NORPAR 15 (ps/cm) | Charged Micelle Electro-phoretic Mobility (E-6 $cm^2$/Vs) | Micelle Charge Density of 0.1% (by weight) Charge Director (μC/$cm^3$) |
|---|---|---|---|
| Control 6 | 43 | 11 | 3.5 |
| Control 8 | 43 | 5.4 | 5.1 |
| Control 5 | 6 | 2.5 | 1.9 |
| Control 7 | 2 | 2.2 | 1.0 |
| Example III | 0.6 | 1.5 | 0.5 |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer consisting essentially of a liquid, thermoplastic resin particles, a nonpolar liquid soluble charge director comprised of an ionic or zwitterionic quaternary ammonium block copolymer, and wherein the number average molecular weight thereof of said charge director is from about 70,000 to about 200,000.

2. A developer according to claim 1 further containing a colorant.

3. A developer according to claim 2 wherein the colorant is a pigment or a dye.

4. A developer in accordance with claim 3 wherein the pigment is cyan, magenta, yellow, red, green, blue, brown, or mixtures thereof; or carbon black.

5. A negatively charged liquid developer consisting of a nonpolar liquid, thermoplastic resin particles, a charge adjuvant, pigment, and a nonpolar liquid soluble polymeric ionic charge director comprised of an ionic or zwitterionic ammonium block copolymer, and wherein the number average molecular weight thereof of said charge director is from about 70,000 to about 200,000.

6. A developer in accordance with claim 5 wherein the resin particles are comprised of a copolymer of ethylene and an α,β-ethylenically unsaturated acid selected from the group consisting of acrylic acid and methacrylic acid, or mixtures thereof.

7. A developer in accordance with claim 5 wherein the resin particles are comprised of a styrene polymer, an acrylate polymer, a methacrylate polymer, a polyester, or mixtures thereof.

8. A developer in accordance with claim 2 wherein the resin particles are comprised of a copolymer of ethylene and acrylic acid, ethylene and methacrylic acid, ethylene and an alkyl ester of acrylic acid, or ethylene and an alkyl ester of methacrylic acid wherein alkyl contains for 1 to about 5 carbon atoms.

9. A developer in accordance with claim 5 wherein the charge director is present in an amount of from about 1 percent to about 20 percent of developer solids and there is enabled a negatively charged toner.

10. A developer in accordance with claim 5 wherein the liquid is an aliphatic hydrocarbon.

11. A developer in accordance with claim 10 wherein the aliphatic hydrocarbon is a mixture of branched hydrocarbons with from about 12 to about 16 carbon atoms.

12. A developer in accordance with claim 10 wherein the aliphatic hydrocarbon is comprised of a mixture of normal hydrocarbons with from about 12 to about 16 carbon atoms.

13. A developer in accordance with claim 5 wherein the resin particles are an alkylene polymer, a styrene polymer, an acrylate polymer, a polyester, or mixtures thereof.

14. A developer in accordance with claim 5 wherein said charge director has a molecular weight of from about 80,000 to about 120,000, and there results a developer with high developer particle charge and low conductivity.

15. A developer in accordance with claim 14 wherein the high developer toner charge provides particle mobilities that range from about 2.0 E-10 $m^2$/vs to about 5 E-10 $m^2$/vs.

16. A developer in accordance with claim 14 wherein the low conductivity of said developer, at 1 percent developer solids, is about 1 ps/centimeter.

17. A developer in accordance with claim 5 wherein the charge director is selected from the group consisting of poly[2-trimethylammoniumethyl methacrylate bromide co-2-ethylhexyl methacrylate], poly[2-triethylammoniumethyl methacrylate hydroxide co-2-ethylhexyl methacrylate], poly[2-trimethylammoniumethyl methacrylate chloride co-2-ethylhexyl methacrylate], poly[2-trimethylammoniumethyl methacrylate fluoride co-2-ethylhexyl acrylate], poly[2-trimethylammoniumethyl acrylate p-toluenesulfonate co-2-ethylhexyl methacrylate], poly[2-trimethylammoniumethyl acrylate nitrate co-2-ethylhexyl acrylate], poly[2-triethylammoniumethyl methacrylate phosphate co-2-ethylhexyl acrylate], poly[2-triethylammoniumethyl acrylate bromide co-2-ethylhexyl acrylate], poly[2-trimethylammoniumethyl methacrylate hydroxide co-2-ethylhexyl acrylate], poly[2-trimethylammoniumethyl acrylate hydroxideco-2-ethylhexyl acrylate], poly[2-trimethylammoniumethyl methacrylate hydroxide co-N,N-dibutyl methacrylamide], poly[2-triethylammoniumethyl methacrylate chloride co-N,N-dibutyl methacrylamide], poly[2-trimethylammoniumethyl methacrylate bromide co-N,Ndibutylacrylamide], poly[2-triethylammoniumethyl methacrylatehydroxide co-N,N-dibutylacrylamide], poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl methacrylate tosylate co-2-ethylhexyl acrylate, poly[2-dimethylammoniumethyl acrylate tosylate co-2-ethylhexyl acrylate], poly[2-dimethylammoniumethyl methacrylate chloride co-2-ethyihexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyi methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

18. A developer in accordance with claim 5 wherein said charage director block copolymer is an AB diblock wherein said A block is a polar A block with a positively charged ammonium nitrogen and said 13 block is a nonpolar B block that functions to effectively dissolve said block copolymer in said nonpolar liquid, and wherein said A block has a number average molecular weight of from about 3,500 to about 120,000 and said B block has a number average molecular weight range of from about 28,000 to about 190,000.

19. A negatively charged liquid developer in accordance with claim 18 wherein said A block comprises from about 60 to about 5 mole percent and said B block comprises from about 40 to about 95 mole percent.

20. A liquid developer in accordance with claim 5 with a mobility of from a negative 1.24 E-10 to a negative 4.40 E-10 meter squared per volts second, and wherein the conductivity is from 1 to 4 picosiemens per centimeter.

21. A liquid developer in accordance with claim 20 wherein the charge director is the AB diblock copolymer poly[2-ethylhexyl methacrylate (B block)-co-N,N-dimethyl-N-ethyl methacrylate ammonium bromide (A block)], and said charge adjuvant is hydroxy bis[3,5-tertiary butyl salicylic] aluminate monohydrate.

22. A negatively charged liquid electrostatographic developer consisting essentially of a nonpolar liquid, thermoplastic resin particles, pigment, a charge adjuvant, and a nonpolar liquid soluble polymeric ionic charge director comprised of an ionic or zwitterionic ammonium block copolymer, and wherein the number average molecular weight thereof of said charge director is from about 80,000 to about 150,000.

23. A developer in accordance with claim 22 wherein the resin particles are comprised of a copolymer of ethylene and vinyl acetate, polypropylene, polyethylene, and acrylic polymers, or mixtures thereof.

24. A liquid developer in accordance with claim 22 wherein the number average molecular weight of said charge director is from about 85,000 to about 100,000.

25. A developer in accordance with claim 22 wherein said zwitterionic diblock copolymer charge director is selected from a group consisting of poly(2-ethylhexyl methacrylate-co-N,N-dimethyl-N-methylenecarboxylate-N-ammoniumethyl methacrylate), poly(2-ethylhexyl methacrylate-co-N,N-dimethyl-N-propylenesulfonate-N-ammoniumethyl methacrylate), poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesuifinate-N-ammoniumethyl methacrylate), poly(2-ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2-ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2-ethylhexyl methacrylate-co-N,N-dimethyl-N-butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2-ethylhexyl methacrylate-co-N,N-d imethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-Nammoniumethyl methacrylate), poly(N,N-dibutylmethacrylamido-co-N,N-dimethyl-N-propylenephosphonate-N-ammoniumethyl methacrylate), poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate) poly(4-vinylpyridinium-N-methylenecarboxylate-co-2-ethylhexyl methacrylate), poly(4-vinylpyridinium-N-propylenesulfonate-co-2-ethylhexyl methacrylate), poly(4-vinylpyridinium-N-propylenephosphonate-co-2-ethylhexyl methacrylate), poly(4-vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co-2-ethylhexyl methacrylate), poly(4-vinylpyridinium-N-ethyleneoxyethylenesulfonate-co-2-ethylhexyl methacrylate), poly(4-vinylpyridinium-N-ethyleneoxyethylenephosphonate-co-2-ethylhexyl methacrylate), and poly[4-vinylpyridinium-N-methylenecarboxylate-co-ptert butylstyrene).

26. A liquid developer in accordance with claim 22 with a mobility of from a negative 1.24 E-10 to a negative 4.40 E-10 meter squared per volts second, and wherein the conductivity is from 1 to 4 picosiemens per centimeter.

27. A liquid electrostatographic developer comprised of (A) a nonpolar liquid having a Kauri-butanol value of from about 5 to about 30 and present in a major amount of from about 50 percent to about 95 weight percent; (B) thermoplastic resin particles and pigment particles; (C) a nonpolar liquid soluble polymeric charge director comprised of an ionic or zwitterionic ammonium block copolymer; and (D) a charge adjuvant; and wherein the number average molecular weight thereof of said charge director is from about 80,000 to about 150,000.

28. A developer in accordance with claim 27 wherein the charge adjuvant is aluminum stearate.

29. A developer in accordance with claim 27 wherein component (A) is present in an amount of from 85 percent to 99.9 percent by weight based on the total weight of the developer solids of resin, pigment, and charge adjuvant which is present in an amount of from about 0.1 percent to about 15 percent by weight, and which percent by weight is based on the weight of the developer solids; and component (C) is present in an amount of from about 0.5 percent to about 100 percent of the developer solids comprised of resin, pigment, and charge adjuvant.

30. A developer in accordance with claim 27 wherein component (D) is present in an amount of 0.1 to 40 percent by weight based on the total weight of developer solids.

31. An imaging method which comprises forming an electrostatic latent image followed by the development thereof with a negatively charged liquid developer consistinq essentially of a nonpolar liquid, thermoplastic resin particles, a charge adiuvant, pigment, and a nonpolar liquid soluble polymeric ionic charge director comprised of an ionic or zwitterionic ammonium block copolymer, and wherein the number average molecular weiqht thereof of said charqe director is from about 70,000 to about 200,000.

32. An imaging method which comprises forming an electrostatic latent image followed by the development thereof with a liquid electrostatic developer comprised of (A) a nonpolar liquid having a Kauri-butanol value of from about 5 to about 30 and present in a major amount of from about 50 percent to about 95 weight percent; (B) thermoplastic resin particles and pigment particles; (C) a nonpolar liquid soluble polymeric charge director comprised of an ionic or zwitterionic ammonium block copolymer; and (D) a charge adiuvant; and wherein the number averaqe molecular weight thereof of said charge director is from about 80,000 to about 150,000.

* * * * *